US007127955B2

(12) United States Patent
Bondhus et al.

(10) Patent No.: US 7,127,955 B2
(45) Date of Patent: Oct. 31, 2006

(54) TORQUE LIMITING HANDLE

(75) Inventors: John Bondhus, Buffalo, MN (US); Mark Petroske, Becker, MN (US)

(73) Assignee: Bondhus Corporation, Monticello, MN (US)

( * ) Notice: Subject to any disclaimer, the term of this patent is extended or adjusted under 35 U.S.C. 154(b) by 90 days.

(21) Appl. No.: 10/799,241

(22) Filed: Mar. 12, 2004

(65) Prior Publication Data

US 2005/0199074 A1 Sep. 15, 2005

(51) Int. Cl.
*B25B 23/14* (2006.01)

(52) U.S. Cl. ..... 73/862.23; 81/480

(58) Field of Classification Search ..... 81/475, 81/480, 472, 473, 467; 73/862.23
See application file for complete search history.

(56) References Cited

U.S. PATENT DOCUMENTS

| | | | | |
|---|---|---|---|---|
| 437,965 | A | 10/1890 | Bock | |
| 1,876,990 | A | 9/1932 | Lormor | |
| 2,396,040 | A | 3/1946 | Darling | |
| 2,410,971 | A | 11/1946 | Hartley | |
| 2,439,980 | A * | 4/1948 | Livermont | 464/23 |
| 2,491,325 | A | 12/1949 | McVey | |
| 2,525,379 | A | 10/1950 | Smilansky | |
| 2,768,547 | A | 10/1956 | Noell | |
| 2,797,564 | A * | 7/1957 | Bonneau et al. | 464/38 |
| 2,919,602 | A * | 1/1960 | Spraragen | 74/553 |
| 2,933,959 | A | 4/1960 | McMahon | |
| 2,968,979 | A | 1/1961 | Aijala | |
| 2,984,133 | A | 5/1961 | Zimmerman | |
| 3,001,430 | A | 9/1961 | Cranford | |
| 3,272,036 | A * | 9/1966 | Van Hoose | 81/477 |
| 3,292,678 | A | 12/1966 | Noga | |
| 3,535,958 | A | 10/1970 | Larson | |
| 3,890,859 | A | 6/1975 | Grabovac et al. | |
| 4,041,811 | A * | 8/1977 | Durant | 81/476 |
| 4,063,474 | A | 12/1977 | Klopping | |
| 4,238,978 | A | 12/1980 | Leone | |
| 4,249,435 | A * | 2/1981 | Villeneuve et al. | 81/477 |
| 4,517,865 | A | 5/1985 | Huang | |
| 4,774,864 | A | 10/1988 | Dossier | |
| 4,901,610 | A | 2/1990 | Larson et al. | |
| 5,123,289 | A | 6/1992 | Potesta | |
| 5,239,875 | A * | 8/1993 | Stasiek et al. | 73/862.23 |
| 5,337,638 | A | 8/1994 | Coss et al. | |
| 5,746,298 | A * | 5/1998 | Krivec et al. | 192/48.3 |
| 6,029,551 | A | 2/2000 | Wu | |
| 6,095,020 | A | 8/2000 | Rinner | |
| 6,155,147 | A | 12/2000 | Dzieman | |
| 6,176,162 | B1 * | 1/2001 | Ludwig et al. | 81/473 |
| 6,308,598 | B1 * | 10/2001 | O'Neil | 81/467 |
| 6,357,538 | B1 * | 3/2002 | Tibbitts | 175/274 |

(Continued)

FOREIGN PATENT DOCUMENTS

| | | |
|---|---|---|
| DE | 8204454 | 7/1982 |

(Continued)

*Primary Examiner*—Edward Lefkowitz
*Assistant Examiner*—George Bonanto
(74) *Attorney, Agent, or Firm*—Faegre & Benson LLP

(57) ABSTRACT

A torque limiting tool including an inner handle having a tool coupling portion, a biasing assembly aperture, and at least one radially oriented slot. At least one interface member is located in the radially oriented slot. The interface member includes an elongated surface generally oriented along a longitudinal axis. A biasing assembly is located in the biasing assembly aperture to provide a longitudinal biasing force that biases the interface member radially outward. An outer handle having an inner surface limits radial displacement of the interface member. The interface members are displaced radially inward when a torque applied to the inner handle exceeds a threshold value.

41 Claims, 9 Drawing Sheets

U.S. PATENT DOCUMENTS 6,358,152 B1 3/2002 Casutt
6,361,259 B1 3/2002 Koeppel et al.
6,487,943 B1 * 12/2002 Jansson et al. ..... 81/475
6,832,533 B1 * 12/2004 Huang ..... 81/475

FOREIGN PATENT DOCUMENTS

DE 4022763 A1 1/1991

* cited by examiner

TORQUE LIMITING HANDLE

FIELD OF THE INVENTION

The present invention relates to a torque limiting tool that uses a longitudinal biasing force to bias interface member radially outward against an inner surface of an outer handle.

BACKGROUND OF THE INVENTION

There are many situations where systems, mechanisms, or devices are assembled at a point of delivery where it is disadvantageous to attach a nut, bolt, or other fastener with too much or too little torque. One solution to this problem is to provide a torque wrench or similar device that is calibrated to apply a pre-determined amount of torque to such a fastener. When the pre-determined amount of torque is applied, the torque wrench slips and the fastener is no longer turned, thereby preventing damage to the fastener or the objects secured by the fastener.

Such torque wrenches are well known in the art. However, many existing torque wrenches require a large number of components, including compression springs and complex drive mechanisms, which must be manufactured from wear resistant metals to deal with high forces. Furthermore, such torque wrenches are frequently bulky because of the large number of components and the manner in which they are positioned inside of the wrench handle.

BRIEF SUMMARY OF THE INVENTION

The present invention is directed to an torque wrench with a reduced number of components, resulting in less complexity and lower cost. The present torque wrench distributes the forces across larger surface areas than a conventional torque wrench, resulting in a reduced need for wear resistant and higher cost materials, such as metals. Low cost materials, such a plastics, can be substituted.

The torque limiting tool includes an inner handle having a tool coupling portion, a biasing assembly aperture, and at least one radially oriented slot. At least one interface member is located in the radially oriented slot. The interface member comprises an elongated surface generally oriented along a longitudinal axis of the tool. A biasing assembly is located in the biasing assembly aperture that provides a longitudinal biasing force that biases the interface member radially outward. An outer handle having an inner surface limits radial displacement of the interface member.

The tool coupling portion can be a tool receiving aperture extending along the longitudinal axis of the inner handle or an outer surface of the inner handle. A plurality of tools are preferably provided that releasably engage with the tool coupling portion.

The biasing assembly aperture is typically connected to the radially oriented slot. The proximal end of the biasing assembly aperture preferably includes a threaded portion. The radially oriented slots preferably include at least one angled surface. The interface member preferably includes at least one surface oriented toward the biasing assembly aperture at an acute angle with respect to the longitudinal axis.

The elongated surface of the interface member is generally flush with the outer surface of the inner handle when the longitudinal biasing force is removed. The biasing force displaces the elongated surface of the interface member above the outer surface of the inner handle. The elongated surface is at least about 0.5 inches long, and more preferably at least 1.0 inches long. The elongated surface can be curvilinear, planar, or a variety of other shapes.

The longitudinal biasing force is typically provided by a spring. The longitudinal biasing force is preferably adjustable.

In one embodiment, the biasing assembly includes a biasing member with a leading edge engaged with the interface member. A retainer engages with the proximal end of the inner handle. A spring is compressively interposed between the biasing member and the retainer. The leading edge of the biasing member preferably form an acute angled with respect to the longitudinal axis. The biasing member is preferably slidably engaged with the biasing assembly aperture. In one embodiment, the retainer is threadably engaged with a proximal end of the inner handle so that the location of the retainer relative to a proximal end of the inner handles is adjustable.

The inner surface of the outer handle can include a variety of structures, such as detents. Alternatively, the inner surface can be curvilinear, smooth, symmetrical or asymmetrical, regular or irregular, etc.

In operation, the interface member is displaced radially inward when a torque applied to the tool coupling portion exceeds a threshold value. The inner handle rotates within the outer handle when a torque applied to the tool coupling portion exceeds a threshold value. The rotation of the inner handle relative to the outer handle can be uni-directional or bi-directional.

When a torque is applied to the inner handle in a first direction that exceeds a threshold value, the inner handle rotates in the first direction within the outer handle. When a torque is applied to the inner handle in a second direction that exceeds the threshold value, the inner handle does not substantially rotate within the outer handle. The inner handle, interface members, and outer handle can be made of metal, ceramic, polymeric materials, a composite, or combinations thereof.

The present invention is also directed to a method of limiting torque transmission. A longitudinal biasing force is generated along a longitudinal axis of an inner handle. The longitudinal biasing force is coupled to one or more interface members. The longitudinal biasing force biases a longitudinally oriented elongated surface on the interface members radially outward. The radial movement of the interface members is restrained by an outer handle surrounding at least a portion of the inner handle. The inner handle is permitted to rotate relative to the outer handle when a torque applied to the inner handle exceeds a threshold level.

The method includes coupling one of a plurality of tools to the inner handle. The longitudinal biasing force can also be adjusted. The elongated surface is displaced above an outer surface of the inner handle. The interface member is displaced radially inward when a torque applied to the inner handle exceeds a threshold value. The inner handle is rotated within the outer handle when a torque applied to the inner handle exceeds a threshold value. The rotation of the inner handle relative to the outer handle can be unidirectional or bi-directional.

In one embodiment, the method includes applying a torque to the inner handle in a first direction that exceeds a threshold value so that the inner handle rotates within the outer handle in the first direction. When torque is applied to the inner handle in a second direction that exceeds the threshold value, however, the inner handle does not substantially rotate in the second direction within the outer handle.

DETAILED DESCRIPTION OF THE INVENTION

Figure 1:
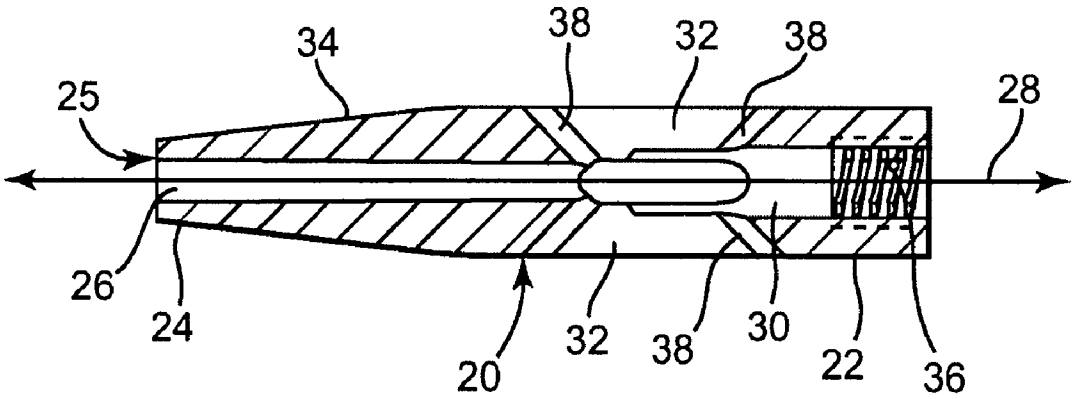
FIG. 1 is a cross-section view of an inner handle in accordance with the present invention.
Figure 15:
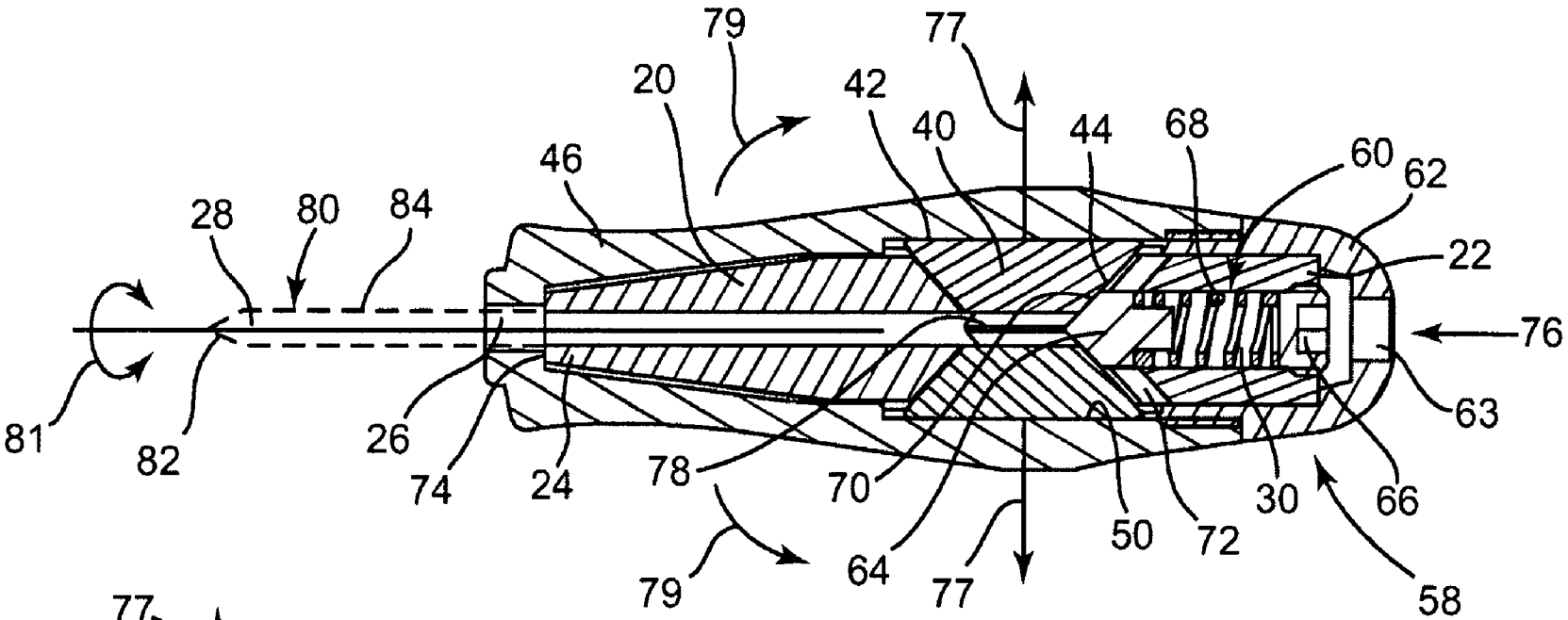
FIG. 15 is a cross-sectional view of an adjustable torque limiting tool in accordance with the present invention.

FIG. 1 illustrates an inner handle 20 for a torque limiting tool (see e.g., FIGS. 15, 23, 24) in accordance with the present invention. The inner handle 20 includes a proximal end 22 and a distal end 24. The distal end 24 of the inner handle 20 includes a tool coupling portion 25. In the illustrated embodiment, the tool coupling portion 25 comprises a receiving aperture 26 that extends along longitudinal axis 28. The tool receiving aperture 26 is designed to releasably engage with a variety of tools 80, such as illustrated in FIG. 15. Alternatively, the tools 80 couple with the outer surface 216 of inner handle 202 (see, e.g., FIG. 24).

Figure 2:
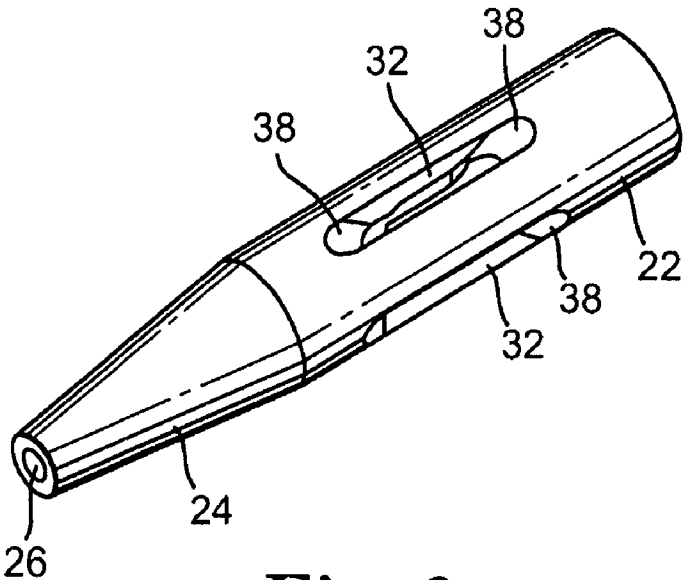
FIG. 2 is a perspective view of the inner handle of FIG. 1.

The distal end 24 can be tapered as shown in FIGS. 1 and 2. Alternatively, the distal end 24 can be straight or a variety of other symmetrical or asymmetrical shapes. A variety of tools 80 can be coupled to the tool coupling portion, such as for example Philips head screwdrivers, flathead screwdrivers, wrenches, socket wrenches or any number of alternative tools.

The inner handle 20 includes a biasing assembly aperture 30 located at or near the proximal end 22. The proximal end 22 of the inner handle 30 preferably includes threaded portion 36. Alternatively, the threaded portion 36 can be located on the outer surface 34 of the inner handle 20. In another embodiment, the tool coupling portion 25 and the biasing assembly aperture 30 can both be located at the proximal end 22, or the distal end 24, of the inner handle 20.

At least one radially oriented slot 32 is located between biasing assembly aperture 30 and distal end 24 of inner handle 20. In the illustrated embodiment, inner handle 20 includes four slots 32. In the embodiment of FIG. 1, the biasing assembly aperture 30 extends into the radially oriented slots 32. In an alternative embodiment, a spacer or other structure is inserted between biasing assembly aperture 30 and slots 32.

Figure 16:
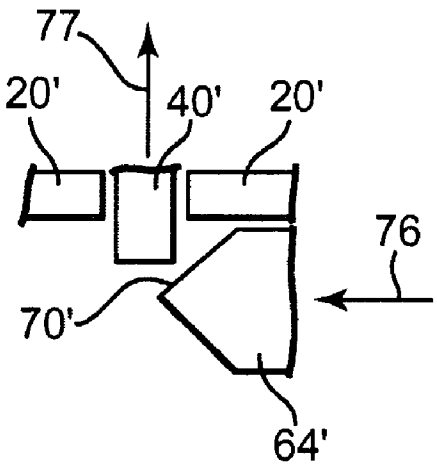
FIG. 16 illustrates an alternate interface member and biasing member in accordance with the present invention.
Figure 18:
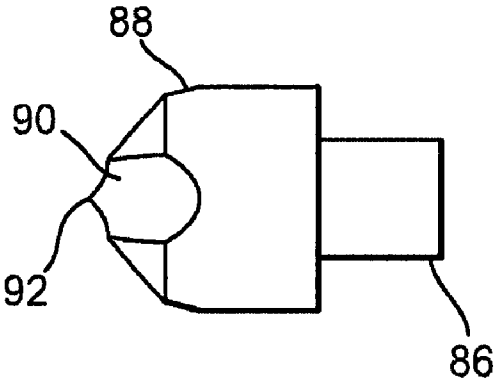
FIG. 18 is a side view of the biasing member of FIG. 17.
Figure 20:
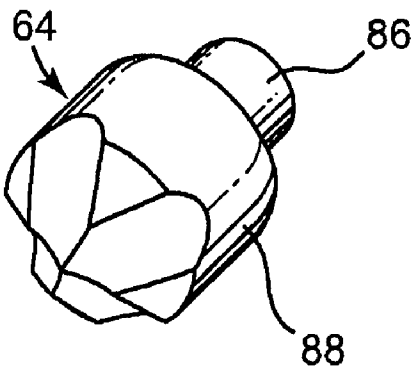
FIG. 20 is a perspective view of the biasing member of FIG. 17.
Figure 17:
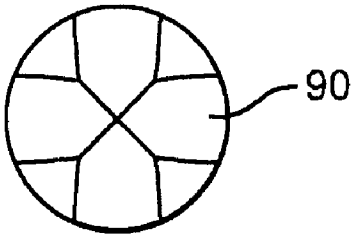
FIG. 17 is a front view of a biasing member in accordance with the present invention.
Figure 19:
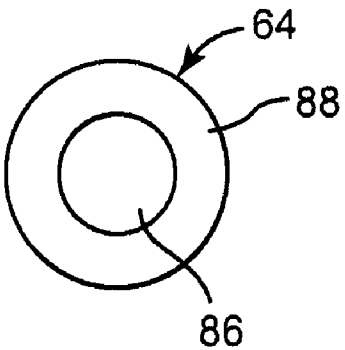
FIG. 19 is a rear view of the biasing member of FIG. 17.

The slots 32 preferably include angled surface 38 oriented toward at least the biasing assembly aperture 30. In the illustrated embodiment, the slots 32 include angled surfaces 38 at both ends. Alternatively, the slots 32 can be formed without angled surfaces, such as illustrated in FIG. 16.

Figure 3:
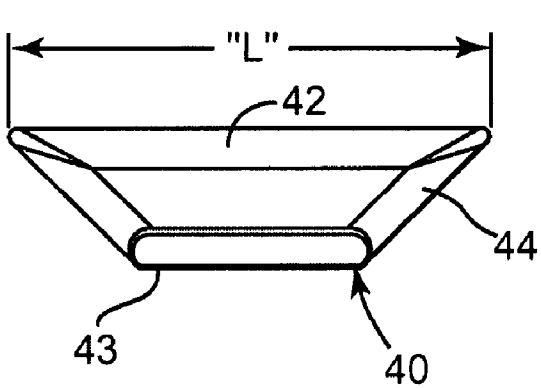
FIG. 3 is a side view of an interface member in accordance with the present invention.
Figure 4:
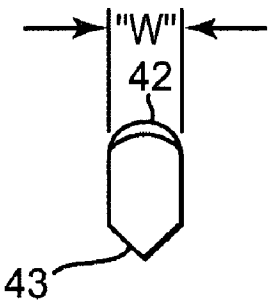
FIG. 4 is an end view of the interface member of FIG. 3.
Figure 5:
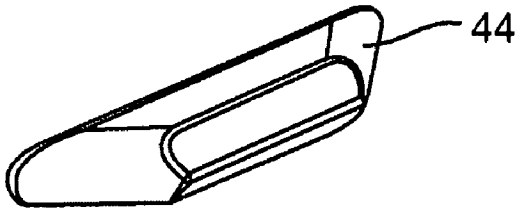
FIG. 5 is a perspective view of the interface member of FIG. 3.
Figure 6:
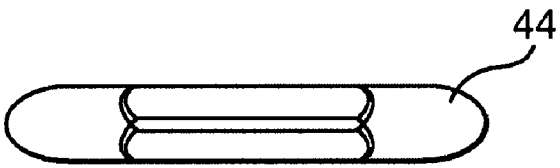
FIG. 6 is a bottom view of the interface member of FIG. 3.
Figure 7:
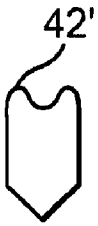
FIGS. 7 and 8 illustrate end view alternate interface members in accordance with the present invention.
Figure 8:
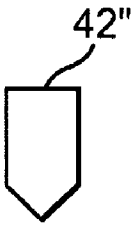
Figure 10:
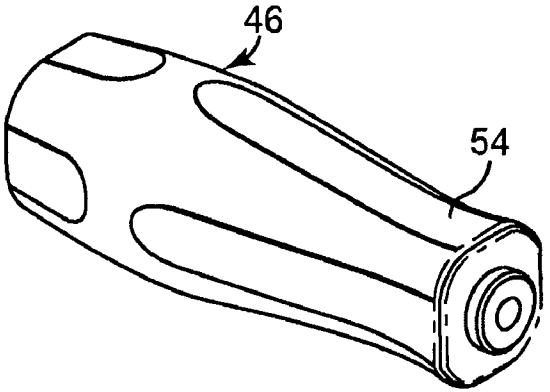
FIG. 10 is a perspective view of the outer handle of FIG. 9.

FIGS. 3 through 8 illustrate one embodiment of a interface member 40 in accordance with the present invention. As illustrated in FIGS. 3 through 4, the interface member 40 preferably includes an elongated surface 42 at a distal end and a proximal end 43. When located in a radially oriented slot 32, the elongated surface 42 is preferably oriented generally parallel with the longitudinal axis 28. In one embodiment, the interface members 40 are sized so that the elongated surfaces 42 is flush with the outer surface 34 of the inner handle 20.

As will be discussed in connection with FIG. 15, the elongated surface 42 is configured to engage with an inner surface 50 of outer handle 46. In the present invention, the elongated surface 42 transmits torque from the outer handle 46 to the inner handle 20, and hence, to the tool 80. By increasing the surface area of the elongated surface 42, higher torque can be transmitted. Alternatively, lower cost materials, such as plastics, can be used to construct the interface elements 40 and handles 20, 46 of the present invention. The elongated surface 42 preferably has a length "L" of at least 0.5 inches, more preferably 1.0 inch, and most preferably at least 1.25 inches. The width "W" is typically less than the length "L".

The interface members 40 are generally wedge-shaped as shown on FIGS. 3 through 8. In the illustrated embodiment, the interface members 40 include at least one side surface 44 that forms an acute angle with respect to the longitudinal axis 28 when inserted in the radially oriented slot 32. The surface 44 is oriented toward the biasing assembly aperture 30 to engage with the biasing assembly 60 (see FIG. 15). In another embodiment, the interface member 40 can be rectangular (see FIG. 16), or a variety of other shapes.

As shown in FIGS. 3 and 4, the cross-section of the elongated surface 42 has a generally arcuate shape. Alternatively, the cross-section of the elongated surface 42' can be curvilinear shape (see FIG. 7), planar 42" (see FIG. 8), or a variety of other shapes.

FIGS. 9 through 13 illustrate various views of one embodiment of the outer handle 46 in accordance with the present invention. Outer surface 48 of the outer handle 46 preferably includes a plurality of grooves or flat portions 54 that facilitate griping. The outer surface 48 can also have a slightly course or pebbled finish to provide a non-slip surface. Alternatively, outer surface 48 can be smooth.

Figure 14:
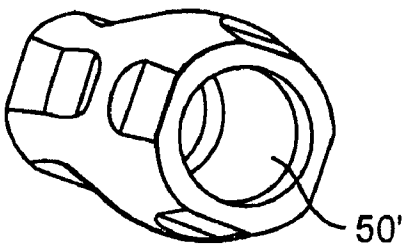
FIG. 14 illustrates an alternate outer handle in accordance with the present invention.
Figure 13:
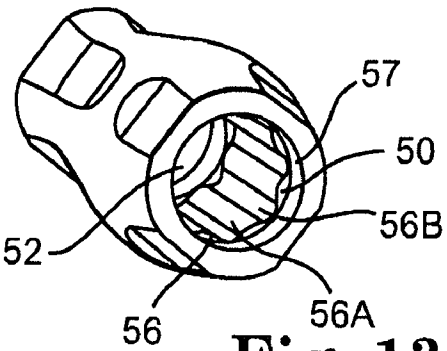
FIG. 13 is a perspective view of the outer handle of FIG. 9.
Figure 12:
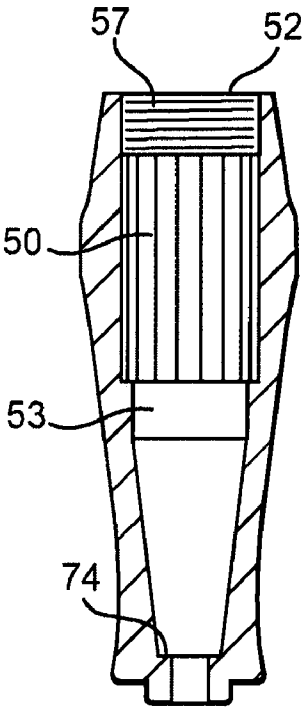
FIG. 12 is a sectional view of the outer handle of FIG. 9.
Figure 9:
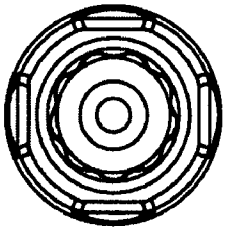
FIG. 9 is an end view of an outer handle in accordance with the present invention.
Figure 11:
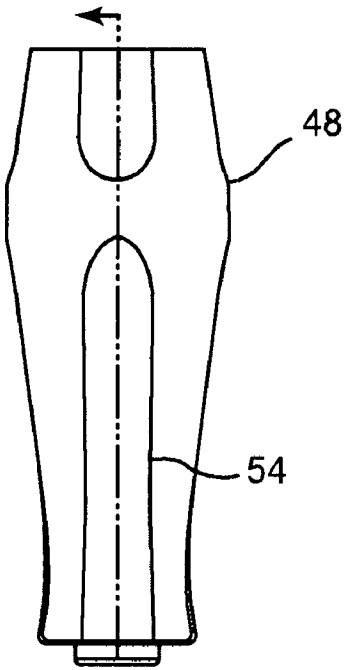
FIG. 11 is a side view of the outer handle of FIG. 9.

The outer handle 46 includes a primary opening 52 that is sized to receive the inner handle 20. Inner surface 53 of the outer handle 46 is preferably smooth. Inner surface 50 of the outer handle 46, however, preferably includes a structure 56 configured to engage with the elongated surface 42 of the interface member 40. In the illustrated embodiment, the structure 56 of the inner surface 50 is curvilinear with peaks 56A and valleys 56B. The peaks 56A and valleys 56B can be regular or irregular in shape and/or spacing, symmetrical or asymmetrical, etc. In another embodiment, the structure 56 comprises a plurality of detents. In an alternate embodiment, the inner surface 50' can be smooth, such as illustrated in FIG. 14.

The inner handle 20, the interface members 40, and the outer handle 46 can be manufactured from a variety of materials, such as metal, ceramic, polymeric materials, composites, or any such combination thereof. Polymeric materials suitable for use in the present invention include acrylonitrile-butadiene-styrene, acetal, acrylic, polyamide nylon 6—6, nylon, polycarbonate, polyester, polyether etherketone, polyetheride, polyether sulfone, polyphenylene sulfide, polyphenylene oxide, polystyrene, polysulfone, and styrene acrylonitrile. In the preferred embodiment, the components 20, 40, and 46 are constructed from reinforced nylon. Suitable reinforcing materials include aramid, carbon, glass, polyester or mica fibers, or some combination thereof.

FIG. 15 illustrates one embodiment of an adjustable torque limiting tool 58 in accordance with the present invention. In the context of the present torque limiting tool 58, torque should be understood as the torque 81 on the inner handle 20 and/or the tool 80 relative to the torque 79 on the outer handle 46. In particular, the torque 79 applied to the outer handle 46 is transmitted to the inner handle 20 and/or tool 80 at the torque 81, up to a threshold torque set by the functioning of the torque limiting tool 58.

The outer handle 46 substantially surrounds inner handle 20. In the illustrated embodiment, the distal end 24 of the inner handle 20 abuts shoulder 74 in the outer handle 46. Cap 62 attaches to the primary opening 52 of the outer handle 46 to secure the inner handle 20 in place. The cap 62 preferably includes threads 65 (see FIG. 21) that engage with threads 57 on the outer handle 46 (see FIGS. 12–14). The cap 62 also preferably includes an opening 63 that provides easy access for adjusting retainer 66.

Biasing assembly 60 includes spring 68 compressively interposed between the retainer 66 and an biasing member 64. The retainer 66 is engaged with proximal end 22 of inner handle 20. In the illustrated embodiment, the retainer 66 is threadably engaged with the threaded portion 36 on the inner handle 20. The threaded portion 36 permits the location of the retainer 66 to be adjusted along the longitudinal axis 28 relative to the inner handle 22. By advancing the retainer 66 toward the distal end 24, the compressive force on the spring 68 is increased. In an alternate embodiment, the location of the retainer 66 is fixed. In the illustrated embodiment, the spring 68 is a conventional coil spring. In an alternate embodiment, the spring 68 can be replaced by an elastomeric material, a memory metal, or a variety of other biasing devices.

The biasing member 64 is positioned to bias the interface members 40 radially outward. The biasing member 64 is preferably located in the biasing assembly aperture 30. Alternatively, the biasing member 64 can be located in the radially oriented slots 32.

In the illustrated embodiment, the biasing member 64 includes a leading edge 70 that is angled with respect to the longitudinal axis 28. The angle of the leading edge 70 is preferably complementary to the angle of the side surface 44 on the interface members 40. In an alternate embodiment, the leading edge 70 could be substantially perpendicular to the longitudinal axis 28.

FIG. 16 illustrates an alternative interface member 40' in accordance with the present invention. The biasing member 64' includes an angled leading edge 70' that acts on a substantially rectangular interface member 40'. The longitudinal biasing force 76 causes the leading edge 70' to urge the interface member 40+ radially outward, generating the radially outward biasing force 77.

Biasing assembly 60 creates a longitudinal biasing force 76 that acts along longitudinal axis 28. The biasing member 64 transmits the longitudinal biasing force 76 to the interface members 40. As the biasing member 64 advances along the longitudinal axis 28 toward the distal end 24, the interface of the angled surfaces 44, 70 slide relative to each other to convert the longitudinal biasing force 76 into a radially outward biasing force 77. The radially outward biasing force 77 urges the elongated surface 42 against the inner surface 50 of the outer handle 46. The magnitude of the radially outward biasing force 77 can be adjusted (increased or decreased) by moving the retainer 66 relative to the inner handle 20.

As shown in FIG. 15, when longitudinal biasing force 76 acts on the interface member 40, the elongated surface 42 is displaced so that it is above the outer surface 34 of inner handle 20. In the configuration of FIG. 15, a space 78 exists between the proximal ends 43 of the interface members 40 and a gap 72 exists between the side surfaces 44 and the angled surfaces 38 (see FIG. 2) on the inner handle 20. The space 78 and the gap 72 provide clearance for some radially inward displacement of the interface members 40.

During normal operating conditions, the elongated surface 42 is typically engaged with one of the valleys 56B on the structure 56 of the outer handle 46. When torque 79 applied to the outer handle 46 is greater than the torque 81 desired at the tool 80, the elongated surface 42 slides out valley 56B and up onto one of the peaks 56A. Movement of the elongated surface 42 out of a valley 56A toward a peak 56A displaces the interface member 40 radially inward. Simultaneously, the biasing member 64 is displaced toward the proximal end 22 of the inner handle 20. The space 78 and the gap 72 provide clearance for the interface members 40 to move radially inward.

Once the elongated surface 42 reaches a peak 56A, continued application of torque 79 causes the interface member 40 to advance to an adjacent valley 56B. The radially outward biasing force 77 displaces the interface member 40 into the adjacent valley 56B.

If the torque 79 continues to exceed the threshold value, the outer handle 46 rotates around the inner handle 20, preventing the tool 80 from transmitting torque 81 greater than the threshold value. In one embodiment, the present adjustable torque limiting tool 58 responds the same way to torque 79 applied in either direction. That is, the rotation of the inner handle 20 relative to the outer handle 46 is bi-directional.

Figure 25:
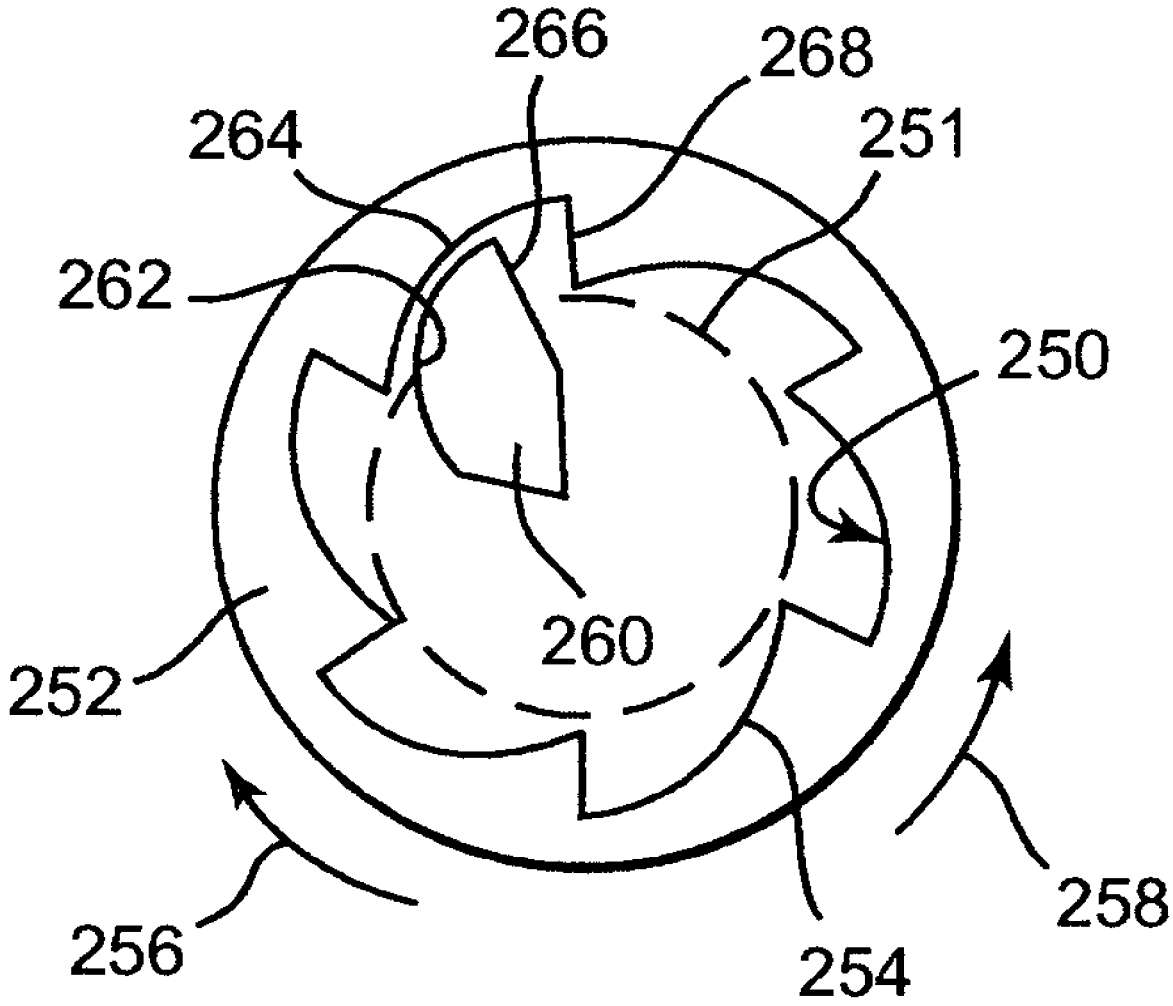
FIG. 25 is a schematic illustration of an interface between an outer handle and an interface member.

In one embodiment, the peaks 56A and valleys 56B, and/or the elongated surface 42, are asymmetrical so as to provide different limits on the torque 81 delivered at the tool 80 depending upon the direction of rotation (see e.g., FIG. 25). In yet another alternate embodiment, the present adjustable torque limiting tool 58 transmits limited toque in one direction of rotation, but transmits significantly higher torque in the other direction, typically limited only by failure of the tool 58 or the item being torqued.

The threshold value corresponds to the torque 79 at which the interface members 40 slip. By increasing the longitudinal biasing force 76, the threshold value is increased. Similarly, by decreasing the longitudinal biasing force 76, the threshold value is decreased. As discussed above, the compression of the spring 68, and hence the longitudinal biasing force 76, can be adjusted by moving the retainer 66 relative to the threaded portion 36. In an alternate embodiment, the spring 68 can be replaced with a spring having a different spring force.

FIGS. 17 through 20 provide various views of the preferred biasing member 64 of the present invention. The biasing member 64 includes base 86 and head 88. Head 88 preferably includes a plurality of notches 90 and a tip 92. Notches 90 are intended to engage with surface 44 of interface members 40. Alternatively, notches 90 can be omitted or could have some other configuration such as planar or curvilinear.

Figure 22:
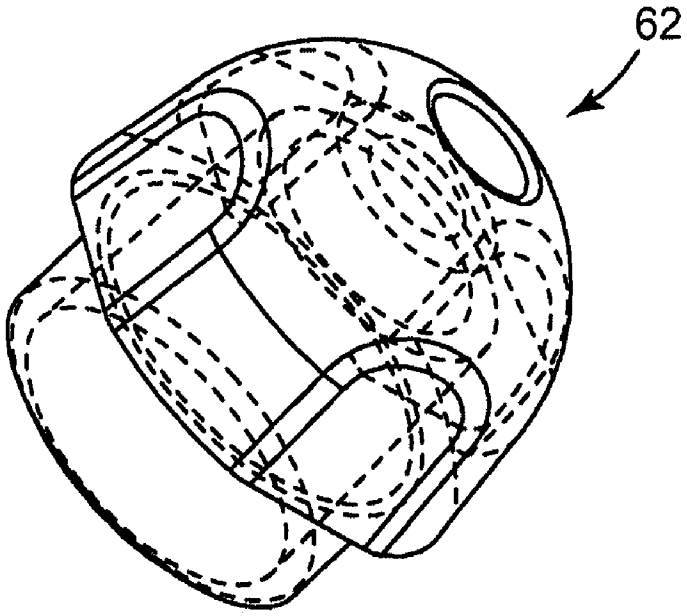
FIG. 22 is a perspective view of the cap of FIG. 21.
Figure 21:
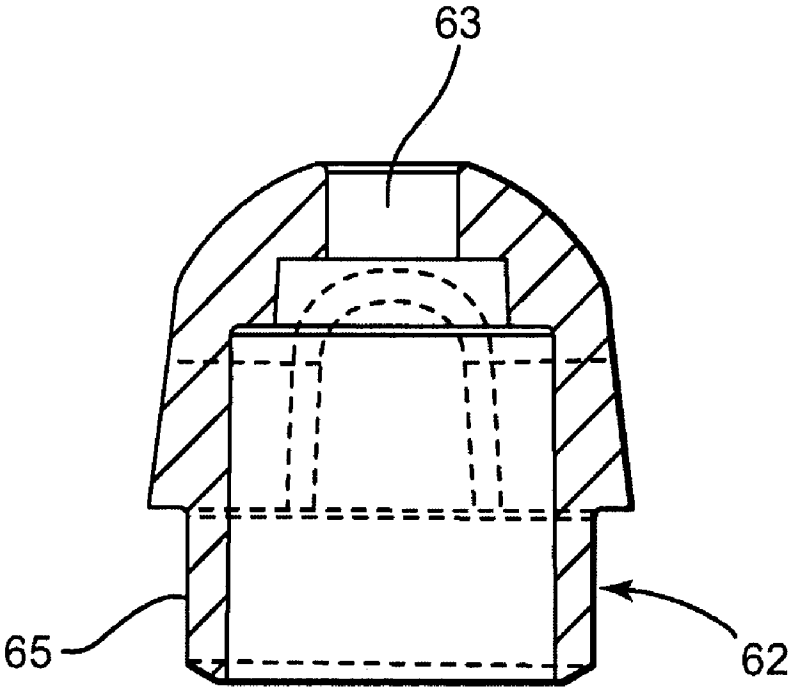
FIG. 21 is a sectional view of a cap for an outer handle in accordance with the present invention.

FIGS. 21 and 22 illustrate the cap 62 in greater detail. The cap 62 preferably includes threads on surface 65 that engage with corresponding threads 57 on the outer handle 46.

Figure 23:
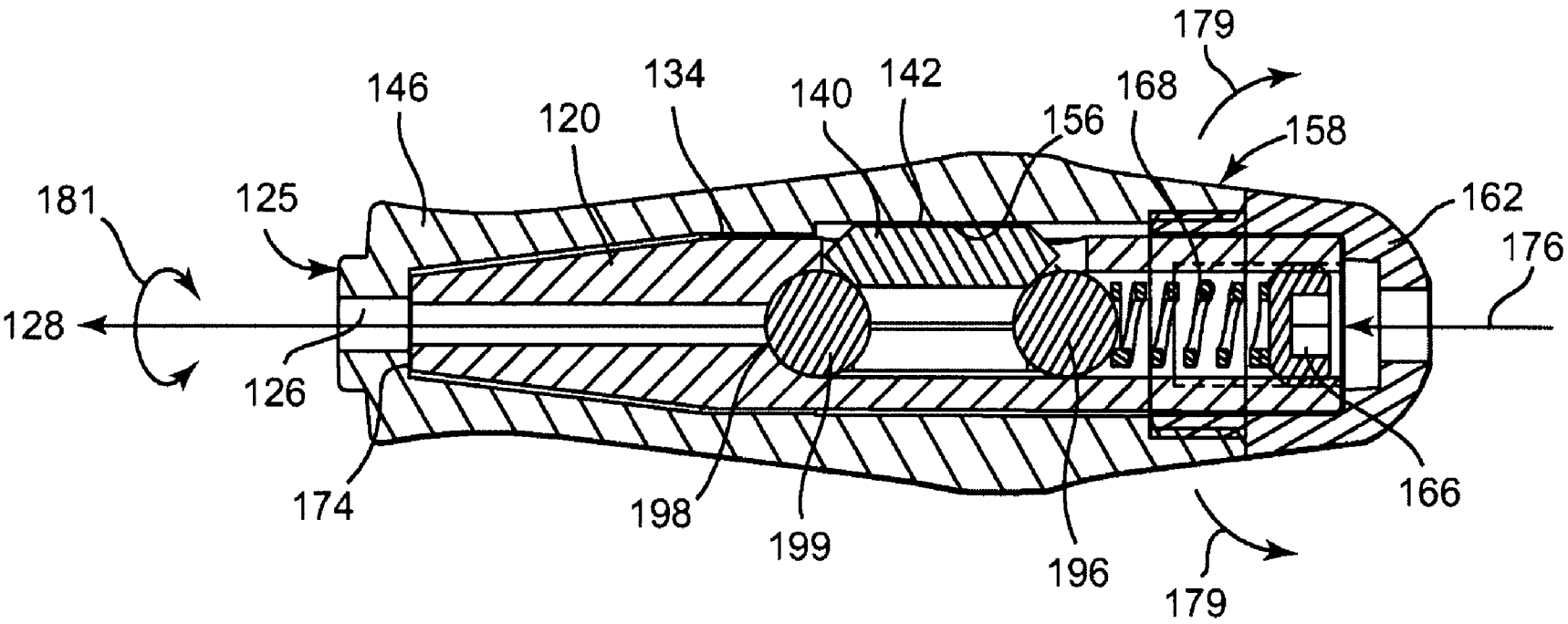
FIG. 23 is a cross-sectional view of an alternate adjustable torque limiting tool in accordance with the present invention.

FIG. 23 illustrates an alternative embodiment of adjustable torque limiting tool 158 in accordance with the present invention. Spring 168 oriented along longitudinal axis 128 acts on ball 196. Application of biasing force 176 on the ball 196 acts to displace interface members 140 radially outward. Shoulder 198 on inner handle 120 acts as a stop for ball 199. The interface of the elongated surface 142 with the inner surface 156 of the outer handle 146 causes the interface member 140 to be generally self-leveling.

When the torque 179 applied to the outer handle 146 exceeds a threshold value of torque 181 desired at the tool coupling portion 125, member 140 is displaced radially inward and the inner handle 120 slips against outer handle 146, thereby limiting the transmission of torque to the tool coupling portion 125.

Figure 24:
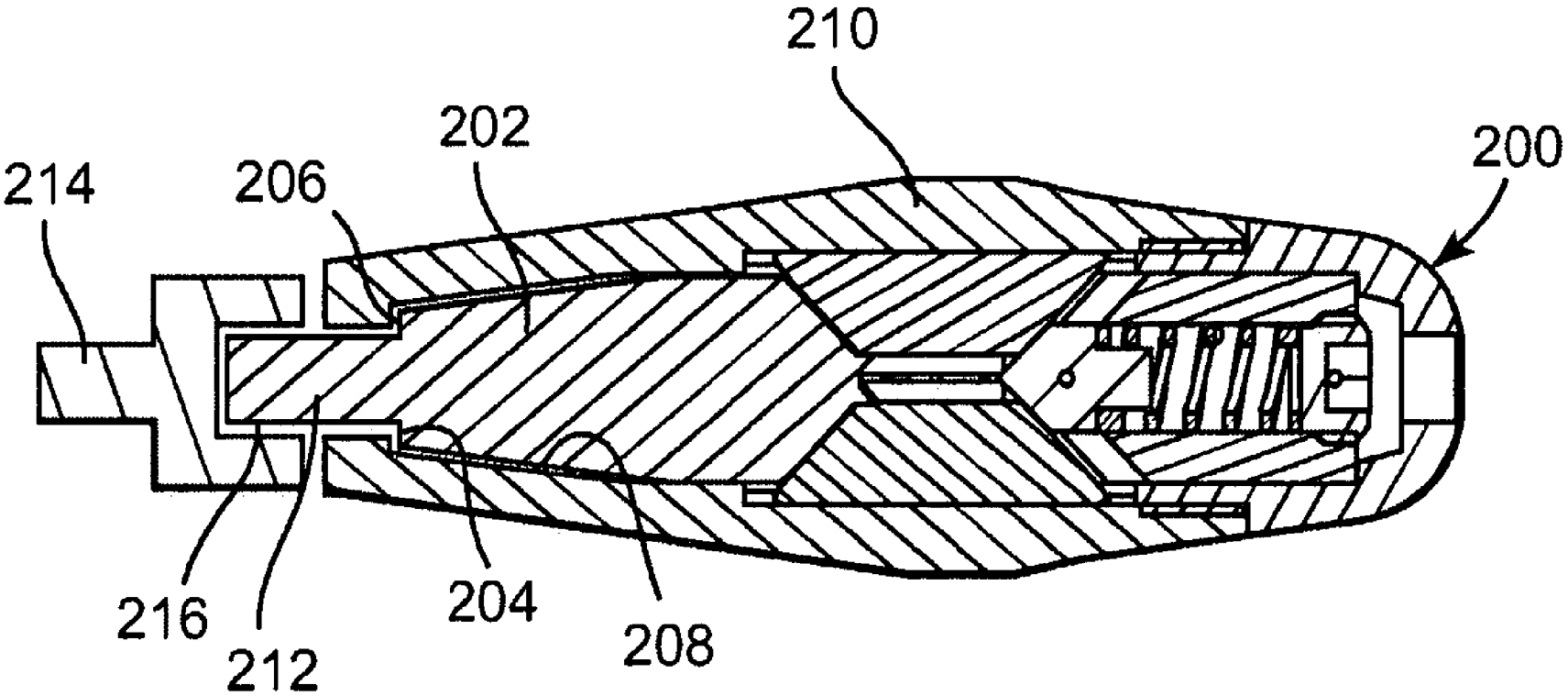
FIG. 24 is a cross-sectional view of another alternate adjustable torque limiting tool in accordance with the present invention.

FIG. 24 illustrates an alternate adjustable torque limiting tool 200 in accordance with the present invention. Inner handle 202 includes a shoulder 204 that engages with a corresponding shoulder 206 on inner surface 208 of the outer handle 210. Distal end 212 of the inner handle 202 extends beyond the outer handle 210, providing a location adapted to couple with a variety of tools 214. In the illustrated embodiment, the tools 214 releasably couple with outer surface 216 of the distal end 212.

FIG. 25 is a schematic illustration of an alternate inner surface 250 of an outer handle 252 engaged with an interface member 260. The inner surface 250 includes a structure 254 that limits torque transmission to the inner handle 251 when the outer handle 252 is rotated in the direction 256. Interface member 260 includes a first surface portion 262 that rides up surface 264 on the structure 254. The second surface portion 266 of the interface member 260 abuts the surface 268 on the structure 254 to transmits theoretically unlimited torque when the outer handle 252 is rotated in the direction 258.

In operation, when a torque applied to the inner handle 251 in the direction 258 exceeds a threshold value, the inner handle 251 rotates within the outer handle 254 in the direction 258. When a torque applied to the inner handle 251 in the direction 256 exceeds the threshold value, the inner handle 251 does not substantially rotate within the outer handle 252.

All of the patents and patent applications disclosed herein, including those set forth in the Background of the Invention, are hereby incorporated by reference. Although specific embodiments of this invention have been shown and described herein, it is to be understood that these embodiments are merely illustrative of the many possible specific arrangements that can be devised in application of the principles of the invention. Numerous and varied other arrangements can be devised in accordance with these principles by those of ordinary skill in the art without departing from the scope and spirit of the invention.

What is claimed is:

1. A torque limiting tool comprising:

an inner handle comprising a tool coupling portion and at least one radially oriented slot;

at least one interface member located in the radially oriented slot, the interface member comprising an elongated surface generally oriented along a longitudinal axis of the inner handle;

a coil spring compressively interposed between a retainer and a biasing member located in a biasing assembly aperture and oriented along the longitudinal axis to provide a longitudinal biasing force that biases the interface member radially outward; and an outer handle having an outer surface oriented along the longitudinal axis adapted to be gripped by a user and an inner surface limiting radial displacement of the interface member, the elongated surface on the interface member in direct contact with the inner surface of the outer handle comprising an elongated surface area of engagement at least about 0.5 inches long and generally oriented along the longitudinal axis of the inner handle, one or more of the inner handle, the outer handle and the interface member comprising a polymeric material.

2. The tool of claim 1 wherein the tool coupling portion comprises a tool receiving aperture extending along the longitudinal axis of the inner handle.

3. The tool of claim 1 wherein the tool coupling portion comprises an outer surface of the inner handle.

4. The tool of claim 1 comprising a plurality of tools each adapted to releasably engage with the tool coupling portion.

5. The tool of claim 1 wherein the biasing assembly aperture is connected to the radially oriented slot.

6. The tool of claim 1 wherein a proximal end of the biasing assembly aperture comprises a threaded portion.

7. The tool of claim 1 wherein the radially oriented slots comprise at least one angled surface.

8. The tool of claim 1 wherein the interface member comprises at least one surface oriented toward the biasing assembly aperture at an acute angle with respect to the longitudinal axis.

9. The tool of claim 1 wherein the elongated surface of the interface member is generally flush with an outer surface of the inner handle when the longitudinal biasing force is removed.

10. The tool of claim 1 wherein the biasing force displaces the elongated surface of the interface member above an outer surface of the inner handle.

11. The tool of claim 1 wherein the elongated surface is about 1.0 inch long.

12. The tool of claim 1 wherein the elongated surface comprises a curvilinear shape.

13. The tool of claim 1 wherein the elongated surface comprises a planar portion.

14. The tool of claim 1 wherein the biasing assembly comprises a spring.

15. The tool of claim 1 wherein the longitudinal biasing force is adjustable.

16. The tool of claim 1 wherein the biasing member comprising a leading edge engaged with the interface member retainer engaged with a proximal end of the inner handle.

17. The tool of claim 16 wherein the leading edge of the biasing member forms an acute angle with respect to the longitudinal axis.

18. The tool of claim 16 wherein the biasing member is slidably engaged with the biasing assembly aperture.

19. The tool of claim 1 wherein the retainer is threadably engaged with a proximal end of the inner handle.

20. The tool of claim 1 wherein the location of the retainer relative to a proximal end of the inner handle is adjustable.

21. The tool of claim 1 wherein the inner surface of the outer handle comprises a plurality of detents.

22. The tool of claim 1 wherein the inner surface of the outer handle comprises a curvilinear surface.

23. The tool of claim 1 wherein the inner surface of the outer handle comprises a generally smooth surface.

24. The tool of claim 1 wherein the inner surface of the outer handle comprises an asymmetrical structure.

25. The tool of claim 1 wherein the outer handle substantially surrounds the inner handle.

26. The tool of claim 1 wherein the interface member is displaced radially inward when a torque applied to the tool coupling portion exceeds a threshold value.

27. The tool of claim 1 wherein the inner handle rotates within the outer handle when a torque applied to the tool coupling portion exceeds a threshold value.

28. The tool of claim 27 wherein the rotation of the inner handle relative to the outer handle is bi-directional.

29. The tool of claim 1 wherein a torque applied to the inner handle in a first direction that exceeds a threshold value causes the inner handle to rotate in the first direction within the outer handle, and a torque applied to the inner handle in a second direction that exceeds the threshold value does not substantially rotate the inner handle within the outer handle.

30. The tool of claim 1 comprising:

an elongated outer handle having a primary opening to a central aperture adapted to receive the inner handle; and a cap adapted to retain the inner handle in the outer handle.

31. The tool of claim 1 wherein one or more of the inner handle, the outer handle and the interface members comprises metal, ceramic, a composite, or a combination thereof.

32. The tool of claim 1 wherein the biasing assembly aperture is Located in the inner handle.

33. A torque limiting tool comprising:

an inner handle comprising a tool coupling means and at least one radially oriented slot;

at least one interface means located in the radially oriented slot, the interface means comprising an elongated surface generally oriented along a longitudinal axis of the inner handle;

a coil spring compressively interposed between a retainer and a biasing member in a biasing assembly aperture and oriented along the longitudinal axis to provide a longitudinal biasing force that biases the interface means radially outward; and an outer handle oriented along the longitudinal axis having an outer surface adapted to be gripped by a user and an inner surface limiting radial displacement of the interface means, the elongated surface on the interface means in direct contact with the inner surface of the outer handle comprising an elongated surface area of engagement at least about 0.5 inches long and generally oriented along the longitudinal axis of the inner handle, one or more of the inner handle, the outer handle and the interface means comprising a polymeric material.

34. A method of limiting torque transmission comprising the steps of:

generating a longitudinal biasing force along a longitudinal axis of an inner handle;

positioning a coil spring compressively between a retainer and a biasing member in a biasing assembly aperture, the coil spring oriented along the longitudinal axis to provide a longitudinal biasing force;

coupling the longitudinal biasing force to one or more interface members, the longitudinal biasing force biasing a longitudinally oriented elongated surface on the one or more interface members radially outward;

positioning at least a portion of the inner handle in an outer handle, the outer handle having an outer gripping surface oriented along the longitudinal axis adapted to be gripped by user;

restraining the radial movement of the one or more interface members in the outer handle such that the elongated surface on the one or more interface members is in direct contact with the inner surface of the outer handle comprising an elongated surface area of engagement at least about 0.5 inches long and generally oriented along the longitudinal axis of the inner handle, one or more of the inner handle, the outer handle and the one or more interface members comprising a polymeric material; and permitting the inner handle to rotate relative to the outer handle when a torque applied to the inner handle exceeds a threshold level.

35. The method of claim 34 comprising coupling one of a plurality of tools to the inner handle.

36. The method of claim 34 comprising adjusting the longitudinal biasing force.

37. The method of claim 34 comprising displacing the elongated surface above an outer surface of the inner handle.

38. The method of claim 34 comprising displacing the one or more interface members radially inward when a torque applied to the inner handle exceeds a threshold value.

39. The method of claim 34 wherein the rotation of the inner handle relative to the outer handle is bi-directional.

40. The method of claim 34 comprising the steps of:

applying a torque to the inner handle in a first direction that exceeds a threshold value so that the inner handle rotates within the outer handle in the first direction; and applying a torque to the inner handle in a second direction that exceeds the threshold value without permitting the inner handle to substantially rotate in the second direction within the outer handle.

41. The method of claim 34 comprising the step of:

removing a spring that provides the longitudinal biasing force from the inner handle; and inserting a different spring having a different spring constant into the inner handle.

* * * * *

UNITED STATES PATENT AND TRADEMARK OFFICE

CERTIFICATE OF CORRECTION

PATENT NO. : 7,127,955 B2
APPLICATION NO. : 10/799241
DATED : October 31, 2006
INVENTOR(S) : John R. Bondhus et al.

It is certified that error appears in the above-identified patent and that said Letters Patent is hereby corrected as shown below:

On The Title Page, Item (56)
References Cited Section

Under the U.S. Patent Documents:

After 2,984,133 A 5/1961, delete "Zimmerman" and replace it with -- Livermont --

Signed and Sealed this

Second Day of January, 2007

JON W. DUDAS
*Director of the United States Patent and Trademark Office*